US006206440B1

(12) United States Patent
McCallum

(10) Patent No.: US 6,206,440 B1
(45) Date of Patent: Mar. 27, 2001

(54) DAMPED MECHANICAL JOINT ASSEMBLY

(76) Inventor: Dennis L. McCallum, Tumac, Inc., P.O. Box E, Fall Creek, OR (US) 97438

( * ) Notice: Subject to any disclaimer, the term of this patent is extended or adjusted under 35 U.S.C. 154(b) by 0 days.

(21) Appl. No.: 09/474,330

(22) Filed: Dec. 29, 1999

(51) Int. Cl.[7] ..... B66C 1/42
(52) U.S. Cl. ..... 294/119.4; 188/83; 188/266; 403/31
(58) Field of Search ..... 294/86.4, 88, 106, 294/119.4; 188/71.1, 72.5, 83, 266, 283, 290, 306, 307, 302, 367, 381; 403/15, 31, 113, 120; 414/626, 729, 732, 738

(56) References Cited

U.S. PATENT DOCUMENTS

| | | | | |
|---|---|---|---|---|
| 4,573,728 | * | 3/1986 | Johnson | 294/119.4 |
| 4,679,839 | * | 7/1987 | Damron | 294/119.4 |
| 4,723,639 | | 2/1988 | Hungerford . | |
| 4,810,020 | * | 3/1989 | Powell | 294/119.4 |
| 5,451,087 | * | 9/1995 | Beaulieu | 294/119.4 |
| 5,713,688 | * | 2/1998 | McCallum | 294/119.4 X |
| 5,779,383 | * | 7/1998 | McCallum | 294/119.4 X |
| 6,119,824 | * | 9/2000 | McCallum | 188/83 |

* cited by examiner

*Primary Examiner*—Johnny D. Cherry
(74) *Attorney, Agent, or Firm*—David S. Alavi

(57) ABSTRACT

A damped mechanical joint assembly comprises two damping members, a joint body positioned therebetween and rotatable relative thereto; and a retainer for maintaining engagement of the damping members with opposite damping surfaces of the joint body. The joint body is provided with a plurality of damping cylinders positioned around the joint rotation axis in a uniformly angularly spaced circular pattern, and each damping cylinder comprises a pair of piston chambers, each opening onto opposite damping surfaces, and a constricted passage connecting the piston chambers. Each of the piston chambers is provided with a piston assembly slidably positioned therein, and each damping cylinder is filled with fluid between the piston assemblies. Each damping member is provided with a circular groove comprising a plurality of uniformly angularly spaced ramped depressions separated by groove barriers. The number of damping cylinders preferably differs from the number of depressions by at least two. The fluid in the damping cylinders urges each piston assembly into engagement with the groove of the corresponding damping member, and the damping members are positioned so that when a piston assembly is located within a ramped depression of the groove of one damping member, the corresponding piston assembly is located at a groove barrier of the groove of the other damping member, thereby resulting in reciprocating motion of the piston assemblies and concomitant flow of the fluid though the constricted passage of the damping cylinders as the joint body rotates relative to the damping members. Viscous resistance to flow of the fluid through the constricted passage as the joint body rotates causes the piston assembly to be urged more strongly into engagement with one of the ramped depressions, thereby producing a damping torque opposing rotation of the joint body, the damping torque increasing with increasing angular velocity of the joint body.

27 Claims, 4 Drawing Sheets

DAMPED MECHANICAL JOINT ASSEMBLY

FIELD OF THE INVENTION

The field of the present invention relates to mechanical joints incorporating braking and/or damping mechanisms. In particular, a mechanical joint is described producing varying damping torque in response to motion of the joint.

BACKGROUND

For purposes of the present specification, "mechanical joint assembly" shall denote an assembly which allows two members to be mechanically joined while allowing rotation of one member with respect to the other about at least one rotation axis. "Universal joint" shall denote a mechanical joint assembly providing rotation about at least two substantially orthogonal axes. Such a joint may be useful in applications in which two members must be mechanically joined but must be allowed to assume an arbitrary relative angle.

In some applications it is desirable for the motion of the moving members about the universal joint to be restricted by damping and/or braking. For example, such a universal joint is useful in situations wherein a first joined member is a boom with a second joined member suspended therefrom being some load carrying means, wherein motion of the load carrying means must be restricted, particularly when not loaded. One particular application of a braked universal joint is suspension of a grappler from a boom of a logging skidder. Several previous designs for a braked universal joint used in this way (also referred to as a swivel link) are described in U.S. Pat. Nos. 4,335,914; 4,417,759; 4,572,567; 4,573,728; 4,679,839; 4,715,641; 4,717,191; 4,723,639; 4,810,020; 5,096,247; 5,110,169; 5,451,087; and 5,601,161, each of said patents being incorporated by reference as if fully set forth herein. A much improved design for a swivel link incorporating frusto-conical surfaces for braking and load-bearing is disclosed in U.S. Pat. Nos. 5,713,688 and 5,779,383 issued to the applicant of the present application, both of said patents being incorporated by reference as if fully set forth herein. Another improved design for a swivel link employing rotational position-dependent braking torque is described in co-pending application Ser. No. 09/087,719, now U.S. Pat. No. 6,119,824 filed in the name of the applicant of the present application, said application being incorporated by reference as if fully set forth herein. The design and construction of swivel link assemblies, many drawbacks of previous swivel link designs, and improvements resulting from the use of frusto-conical braking and load-bearing surfaces are fully disclosed in these patents and application, and need not be reiterated herein.

A primary figure-of-merit for a swivel link is the number of hours of use in the field before replacement of the friction members of the joint (friction discs in older designs, friction cones in the frusto-conical design). Anything that reduces wear of the braking/friction members (and therefore reduces concomitant down time, maintenance time, and maintenance costs) is highly desirable.

During use of a swivel link, and many other braked mechanical joints, it is often the case that slow motions about the joint are insignificant and can be tolerated, while faster motions are undesirable and must be reduced or prevented (for example, to prevent injury and/or equipment damage). However, previous joints provide a constant braking torque relatively independent of the speed of motion. Reduction of the braking torque for slow rotations would reduce unnecessary wear on the braking/friction members, "saving" the braking/friction members for suppression of faster rotations.

In addition, earlier braked joint assemblies have relied on friction for generating braking torque. Mating surfaces are thrust together to generate this friction, and these surfaces must necessarily wear during use of the joint. Obviously, these surfaces could not be lubricated to reduce wear. A joint in which braking torque was not generated by friction would not be subject to such wear, could be thoroughly lubricated to reduce wear of moving surfaces, and would therefore have a longer operational lifetime before requiring maintenance or replacement.

It is therefore desirable to provide a damped mechanical joint assembly in which a relatively smaller damping torque is applied during slower motions of the joint, while a relatively larger damping torque is applied during faster motions of the joint. It is be desirable to provide a damped mechanical joint assembly in which the damping torque is generated without the use of friction members.

SUMMARY

Certain aspects of the present invention may overcome one or more aforementioned drawbacks of the previous art and/or advance the state-of-the-art of braked and/or damped mechanical joint assemblies, and in addition may meet one or more of the following objects:

- To provide a damped mechanical joint assembly wherein the damping torque varies with angular velocity of rotation around the joint;
- To provide a damped mechanical joint assembly wherein the damping torque increases with increasing angular velocity of rotation around the joint;
- To provide a damped mechanical joint assembly wherein the damping torque decreases with decreasing angular velocity of rotation around the joint;
- To provide a damped mechanical joint assembly wherein the wear of damping members is reduced;
- To provide a damped mechanical joint assembly wherein the wear of damping members is reduced during slower rotation around the joint;
- To provide a damped mechanical joint assembly wherein damping torque is generated with little or no concomitant friction;
- To provide a damped mechanical joint assembly wherein damping torque is generated with little or no concomitant frictional wear;
- To provide a damped mechanical joint assembly with a longer useful field life than previous joint assemblies; and
- To provide a damped mechanical joint assembly with reduced maintenance requirements.

One or more of the foregoing objects may be achieved in the present invention by a damped mechanical joint assembly comprising: a) first and second damping members adapted for non-rotatably engaging one of two joined members; b) a joint body positioned therebetween and rotatable relative thereto; and c) a retainer for maintaining engagement of the first and second damping members with opposite damping surfaces of the joint body. The joint body is provided with a plurality of damping cylinders positioned around the joint rotation axis in a uniformly angularly spaced circular pattern, and each damping cylinder comprises a pair of piston chambers, each opening onto opposite damping surfaces, and a constricted passage connecting the piston chambers. Each of the piston chambers is provided with a piston assembly slidably positioned therein, and each damping cylinder is filled with fluid between the piston assemblies. Each damping member is provided with a circular groove comprising a plurality of uniformly angularly spaced ramped depressions separated by groove barriers. The number of damping cylinders preferably differs from the number of depressions. The fluid in the damping cylinders urges each piston assembly into engagement with the groove of the corresponding damping member, and the damping members are positioned so that when a piston assembly is located within a ramped depression of the groove of one damping member, the corresponding piston assembly is located at a groove barrier of the groove of the other damping member, thereby resulting in reciprocating motion of the piston assemblies and concomitant flow of the fluid though the constricted passage of the damping cylinders as the joint body rotates relative to the damping members. Viscous resistance to flow of the fluid through the constricted passage as the joint body rotates causes the piston assembly to be urged more strongly into engagement with one of the ramped depressions, thereby producing a damping torque opposing rotation of the joint body, the damping torque increasing with increasing angular velocity of the joint body.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

For purposes of the present written description and/or claims, exemplary joints are shown having two substantially orthogonal rotation axes. However, the subject matter of the present invention is equally applicable to joints having one, two, three, or more axes. Furthermore, the subject matter of the present invention may be employed in any number of the axes of a joint assembly, and in particular may be employed in only one axis, two axes, or more axes, up to the total number of axes in a joint assembly.

Figure 1:
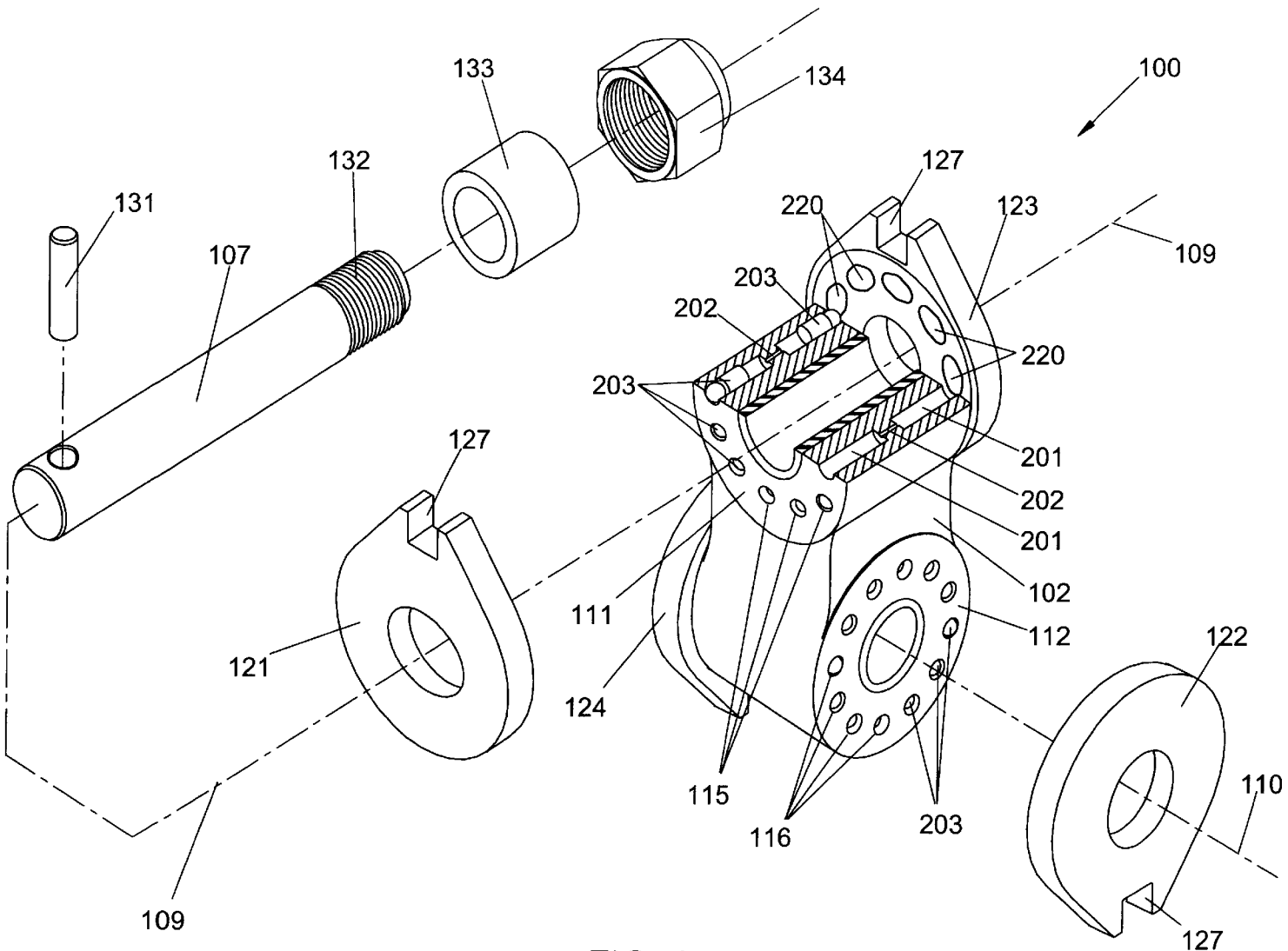
FIG. 1 shows an exploded and partially cut-away view of a damped universal joint assembly according to the present invention.

FIG. 1 shows an exploded and partially cut-away view of an embodiment of a two-axis damped joint assembly 100 according to the present invention. Joint assembly 100 comprises a central joint body 102 defining two substantially orthogonal joint rotation axes 109 and 110. Joint body 102 may be provided with a coaxial bore corresponding to each joint rotation axis 109 and 110, and a shaft may be provided for each joint rotation axis (shaft 107 for joint rotation axis 109; shaft not shown for joint rotation axis 110) and received within the corresponding bore. A single axis joint assembly may be constructed in a similar fashion, with joint body 102 substantially non-rotatably engaging one of the joined members. Joint assemblies having more than two axes may be analogously constructed as well. For the joint assembly of FIG. 1, damping surfaces 111 and 113 are provided on opposite faces of joint body 102 and are substantially perpendicular to joint rotation axis 109, while damping surfaces 112 and 114 are provided on opposite faces of joint body 102 and are substantially perpendicular to joint rotation axis 110. Joint body 102 is provided with two sets of damping cylinders 115 and 116, positioned around joint rotation axes 109 and 110, respectively. As shown in FIG. 1 and in more detail in the partial cross-sectional view of FIGS. 2A and 2B, each damping cylinder comprises a first piston chamber 201 opening onto one of the corresponding damping surfaces, a second piston chamber 201 opening onto the opposite damping surface, and a constricted passage 202 connecting the first and second piston chambers 201. A piston assembly 203 is slidably positioned within each piston chamber 201 of each of the sets of damping cylinders 115 and 116.

Figure 3B:
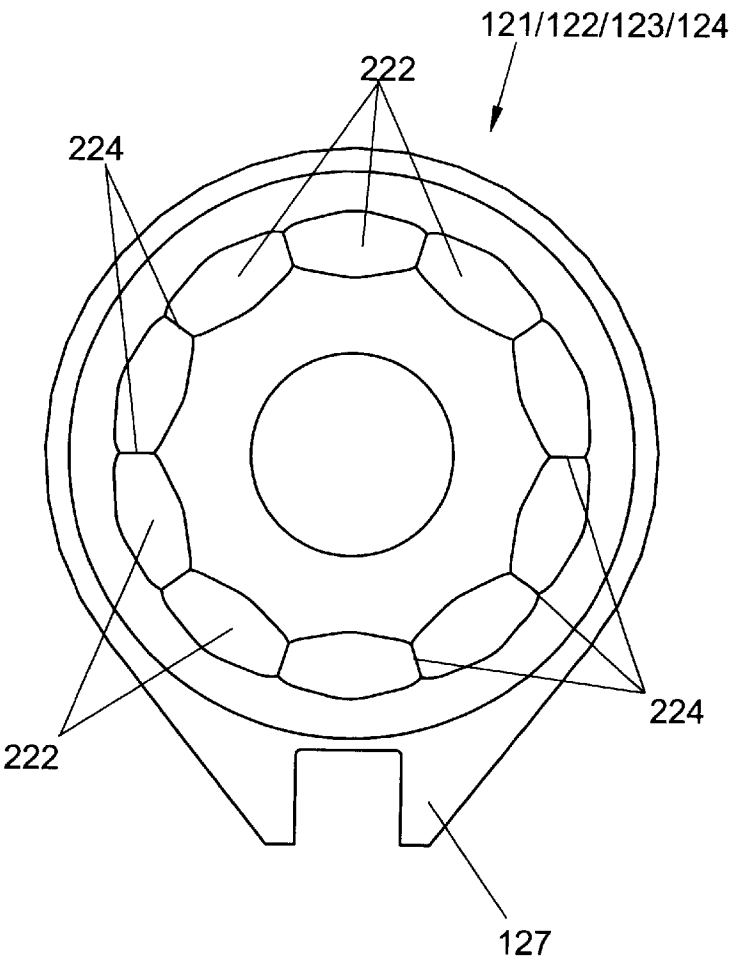
FIGS. 3A and 3B show damping members according to the present invention.
Figure 3A:
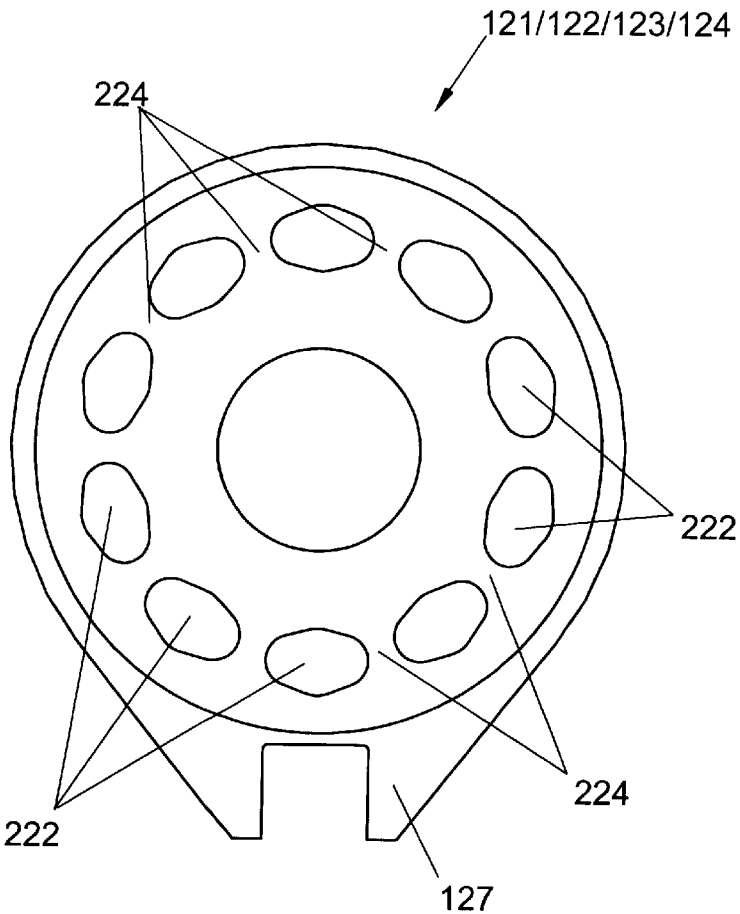

Joint assembly 100 further comprises a pair of damping members 121 and 123 provided for joint rotation axis 109 and engaging damping surfaces 111 and 113, respectively, of joint body 102, and damping members 122 and 124 provided for joint rotation axis 110 and engaging damping surfaces 112 and 114, respectively, of joint body 102. Each of the damping members is adapted to substantially non-rotatably engage one of the first or second joined members (not shown). Slotted flange 127 may be employed to achieve such non-rotatable engagement. Many other examples of structures and/or methods for achieving such non-rotatable engagement are disclosed in the patents and application cited hereinabove and incorporated herein by reference; any such suitable means for substantially non-rotatably engaging a joined member may be employed in the present invention without departing from inventive concepts disclosed and/or claimed herein. Each damping member is provided with a substantially circular groove 220 on the surface engaged with the corresponding damping surface of joint body 102, as shown in detail in FIGS. 3A and 3B. The groove 220 is substantially concentric with respect to the corresponding joint rotation axis, and comprises a plurality of ramped depressions 222 separated by groove barriers 224. The ramped depressions 222 are substantially uniformly angularly spaced around groove 220, and differ in number from the number of damping cylinders around the corresponding joint rotation axis. The number of ramped depressions are equal for grooves 220 of corresponding pairs of damping members (121 and 123 for joint rotation axis 109; 122 and 124 for joint rotation axis 110). The damping cylinders and the ramped depressions for each joint rotation axis may each number from about 3 to about 50, preferably from about 6 to about 25, and most preferably number 12 and 10, respectively, for each joint rotation axis of a most preferred embodiment of the present invention. Any suitable numbers of damping cylinders and ramped depressions may be employed without departing from inventive concepts disclosed and/or claimed herein, and discussed further hereinbelow. Ramped depressions 222 of groove 220 may be separated by portions of the engaged surface of the damping member, as shown in FIG. 3A. Alternatively, ramped depressions 222 may be sufficiently large and/or deep so that they abut one another at groove barriers 224, as shown in FIG. 3B and further depicted in the linearized circumferential sectional view shown in FIG. 4. For the groove depicted in FIG. 3A, groove barriers 224 are flush with the engaged surface of the damping member, and in fact a portion of the engaged surface forms a flattened top portion of each groove barrier.

For the groove depicted in FIG. 3B, groove barriers 224 may be flush with the engaged surface of the damping member, or may be recessed within the groove 220.

For each damping surface of joint body 102, the piston chambers of the corresponding set of damping cylinders are arranged in a substantially uniformly angularly spaced substantially circular pattern. The circular pattern is substantially concentric with respect to the corresponding joint rotation axis, and has substantially the same radius as the radius of the groove 220 of the corresponding damping member. Each of the damping cylinders is filled with fluid between the piston assemblies 201, thereby urging each of the piston assemblies into engagement with the groove 220 of the corresponding damping member.

Figure 4:
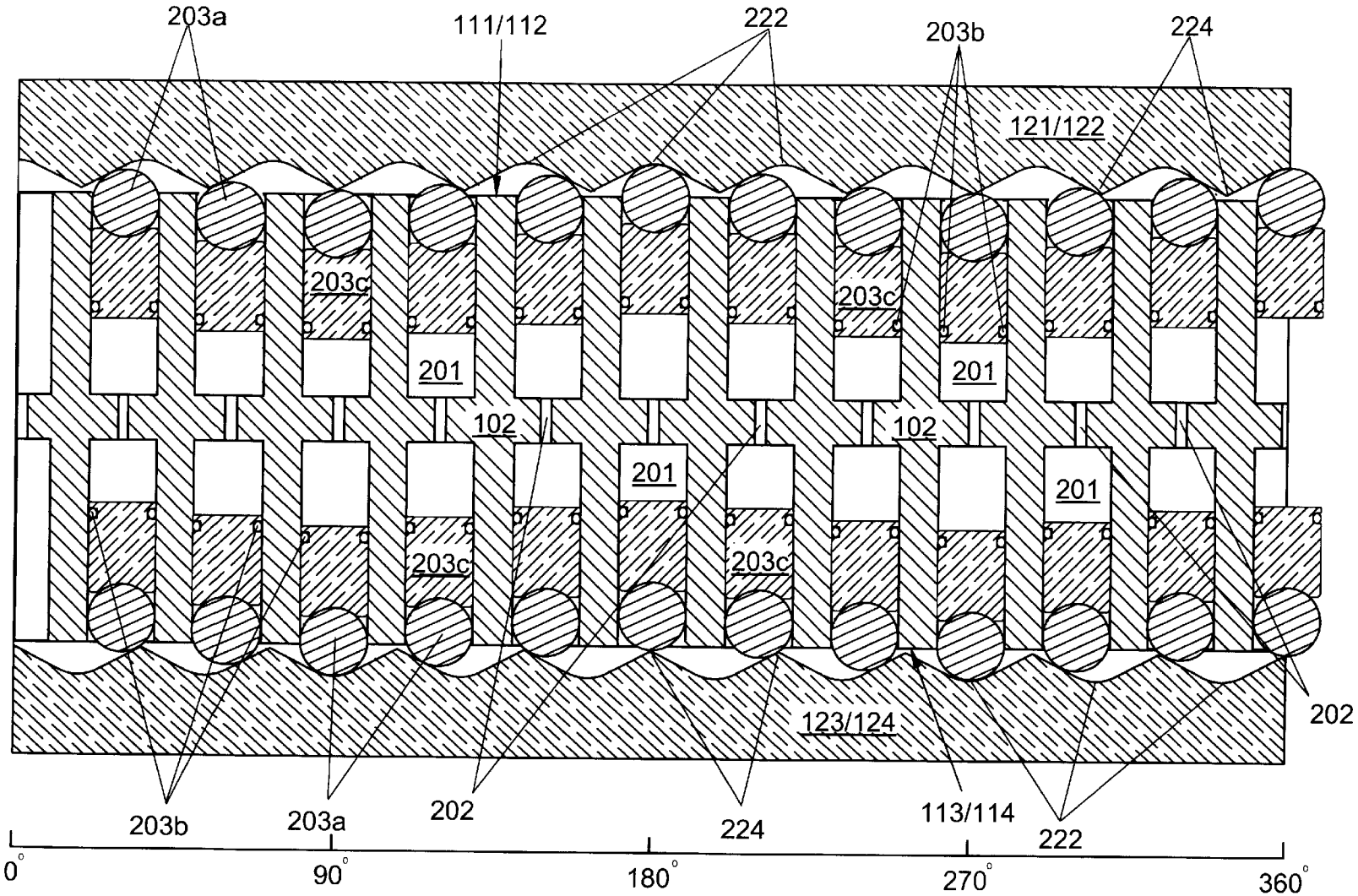
FIG. 4 shows a linearized circumferential sectional view of a damped joint assembly according to the present invention.

Corresponding pairs of damping members (121 and 123 for joint rotation axis 109; 122 and 124 for joint rotation axis 110) are positioned so that when a piston assembly 203 of a damping cylinder is located within a ramped depression 222 of groove 220 of one damping member, the other piston assembly 203 of the same damping cylinder is located at a corresponding groove barrier 224 of the groove of the other damping member. In this way, rotation of joint body 102 about a joint rotation axis relative to the corresponding pair of damping members results in reciprocating motion of the piston assemblies 203 within the piston chambers 201 of the damping cylinders, as well as concomitant flow of fluid through the constricted passage 202 of the damping cylinders. This is depicted in FIG. 4, which shows each piston assembly pair in a different position, depending on the positions of the ramped depressions 222 and groove barriers 224 of grooves 220. Any spatial arrangement of grooves, ramped depressions, groove barriers, and piston chambers that produces this functional result may be employed without departing from inventive concepts disclosed and/or claimed herein. In a preferred embodiment of the present invention, the piston chambers of each damping cylinder are substantially collinear, each of the circular patterns of the piston chambers and each of the grooves 220 all have substantially the same radius, and each of the corresponding pairs of damping members is positioned so that each of the ramped depressions of the groove 220 of one damping member is positioned opposite a corresponding groove barrier 224 of the groove 220 of the other damping member.

Viscous resistance to flow of fluid through constricted passages 202 of the damping cylinders gives rise to a damping torque opposing relative rotation of the joint body and damping members about a joint rotation axis. At relatively small angular velocities, the reciprocating motion of piston assemblies 203 is relatively slow, as is the flow of fluid through the constricted passage 202. The slow fluid flow requires only a small fluid pressure differential across the constricted passage 202, and only a small force is exerted by piston assembly 203 on the ramped portion of ramped depression 222 as piston assembly 203 moves up toward groove barrier 224. The sum of such forces from all of the damping cylinders on the damping members of a joint rotation axis produces the damping torque opposing rotation about the joint rotation axis, and this damping torque is relatively small at relatively small angular velocities. As the angular velocity increases, however, larger fluid pressure differentials develop across constricted passages 202 of the damping cylinders, resulting in larger forces exerted by piston assemblies 203 on the ramped portions of ramped depressions 222 and a larger damping torque opposing rotation about the joint rotation axis. The damping torque therefore increases with increasing angular velocity, as desired. The variation of damping torque with increasing angular velocity may be controlled by: i) varying the viscosity and/or compressibility of the fluid within the damping cylinders; ii) varying the length, shape, cross-sectional area/profile, and/or other hydrodynamic characteristics of constricted passage 202; and/or iii) varying the width, depth, slope, and/or shape of ramped depressions 222. In general, larger viscous resistance to flow results in more rapid increase in damping torque with increasing angular velocity. More steeply sloped ramped depressions 222 may also produce damping torque that increases more rapidly with increasing angular velocity. The response of the damping torque to angular frequency of rotation about the joint rotation axis may therefore be tailored for a specific application environment and desired damping characteristics for the joint. For example, a joint could be constructed exhibiting a "cut-off" angular velocity below which the damping torque increases only slowly and above which the damping torque increases quite rapidly. The cut-off angular velocity should preferably be chosen to be below the angular velocity corresponding to the natural pendulum motion of a grapple suspended from a boom of a logging skidder, for example.

Figure 2B:
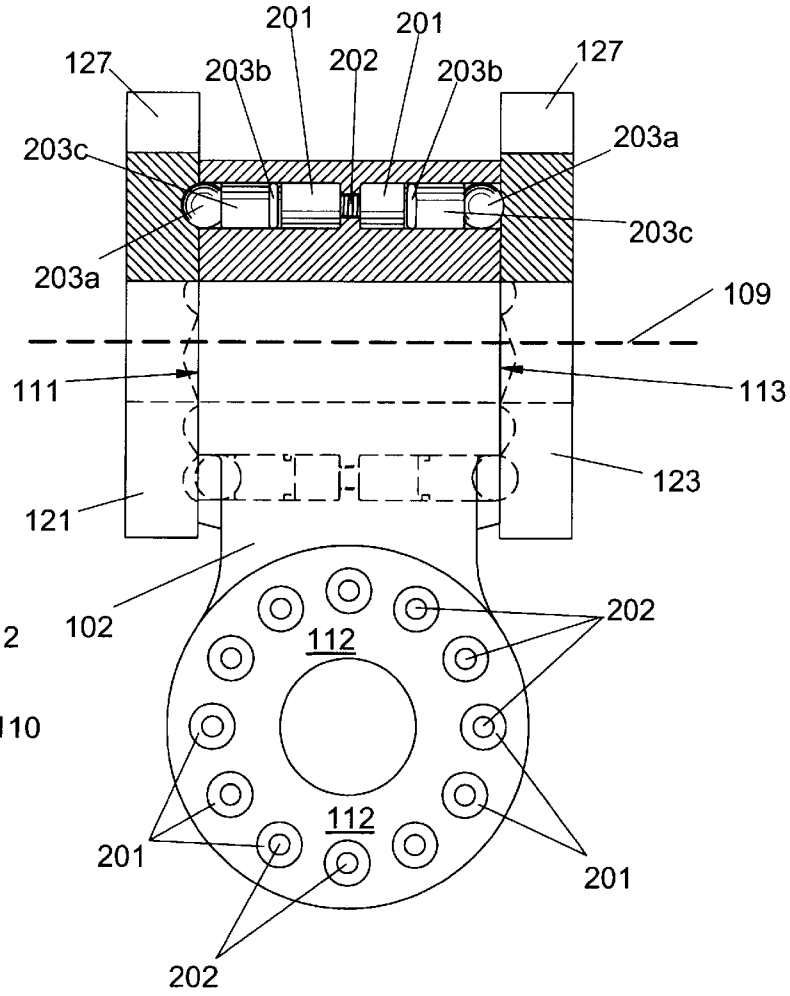
FIGS. 2A and 2B show partial cross sectional views of a partially disassembled damped universal joint assembly according to the present invention.
Figure 2A:
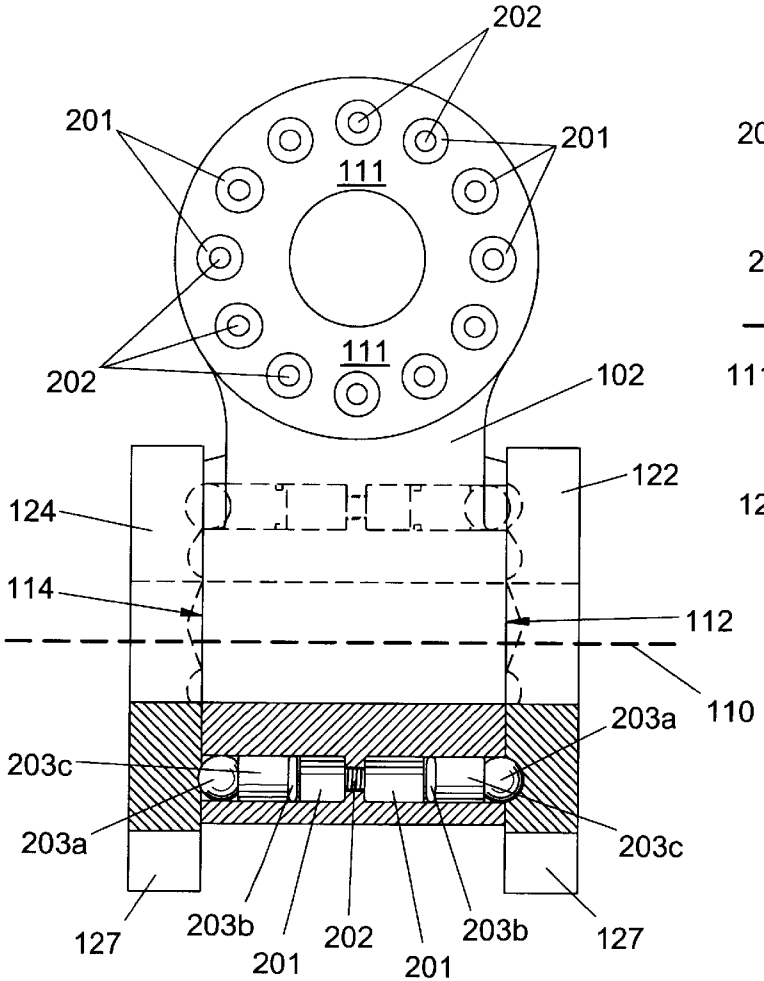

In an alternative embodiment of the present invention, constricted passage 202 may be a replaceable, interchangeable insert, thereby facilitating rapid adjustment of the angular velocity dependence of the damping torque. For example, corresponding piston chambers 201 may be connected by a relatively unconstricted, threaded bore, into which a threaded insert with constricted passage 202 therethrough may be screwed, as shown in FIGS. 2A and 2B. In an alternative embodiment of the present invention, each of piston chambers 201 may be further provided with a fluid pressure relief valve, thereby limiting the fluid pressure differential that may develop across constricted passage 202. This may limit or prevent damage to the joint assembly when subjected to excessively large peak angular velocities. Such a fluid relief valve, or alternatively a pressure gauge, may also serve as an angular velocity sensor.

The differing numbers of damping cylinders and ramped depressions serve to even out the damping torque produced by the forces exerted by piston assemblies 203 on ramped depression 222. The force is exerted primarily as piston member 203 moves up the ramped portion of a depression 222 toward a groove barrier 224. Using the same number of damping cylinders and depressions would result in an oscillating torque, as the piston assemblies moved in unison through depressions 222 toward barriers 224 and exerted their forces together. Further, the point of application of the oscillating torque would oscillate from one face of the joint body to the opposing face, as the pistons engaged depressions of one groove and then the other, and would generate considerable vibration and wear on the joint assembly. By employing differing numbers of damping cylinders and ramped depressions, the force exerted by each piston assembly is staggered with respect to the other piston assemblies, resulting in smaller variations in the overall damping torque produced by all of the piston assemblies acting simultaneously. It should also be noted that the forces exerted by piston assemblies 203 on the damping members have both a tangential component (which produces the damping torque) but also a component substantially normal to the damping surfaces of the joint body and corresponding engaged surfaces of the damping members. If the piston assemblies moved in unison, the joint body may oscillate axially between the damping members, thereby subjecting the joint assembly and joined members to increased vibration and wear.

By employing differing numbers of damping cylinders and ramped depressions, differing numbers of distinct angular regions of each groove produce damping torque and axial force at any given instant as the joint rotates. In fact, the number of distinct angular regions producing damping torque and axial force is equal to the difference between the number of grooves and the number of ramped depressions, and furthermore, these angular regions on one groove are "out of phase" or equivalently are in "anti-phase" with respect to the corresponding groove of the other damping member. In a preferred embodiment of the present invention, the number of damping cylinders and the number of grooved depressions differ in number by at least two, so that the resulting axial forces on the joint body are symmetrically disposed around the groove. If the number of damping cylinders and ramped depressions differed by one, damping torque and axial force are produced in only one region of a groove 220 at any given time, and this region moves around the groove with motion of the joint. Opposing axial force would be produced on the other face of the joint body 180° from the first region, resulting in a net torque on the joint body and thereby producing a wobbling motion of the joint body between the damping members and subjecting the joint assembly and joined members to increased vibration and wear.

If the numbers of damping cylinders differ by two (or more), then two (or more) symmetrically disposed angular regions of damping torque and axial force result on each groove, and there is little or no net torque to produce any wobbling motion of the joint body. This is well-illustrated in FIG. 4. If the motion of the joint appears as motion of the joint body to the right in FIG. 4, then the lower groove produces damping torque (force directed to the left) and axial force (directed upward) at and just before 90° and 270°. The upper groove, on the other hand, produces damping torque (force directed to the left) and axial force (directed downward) at and just before 180° and 360°. The overall result is that the joint body is subjected to opposing axial forces on adjacent quadrants, which produces little or no unwanted axial oscillation or wobbling, and reduces vibration and wear on the joint assembly and joined members. As illustrated in the Figures and disclosed hereinabove, a most preferred embodiment of the present invention has twelve (12) damping cylinders and ten (10) ramped depressions in each groove, resulting in two diametrically opposed regions in each groove where damping torque and axial forces are generated, as described hereinabove. Other numbers (3, 4, 5, etc.) of distinct angular regions of groove 220 where damping torque is produced may be utilized with similar balancing of opposing axial forces by choosing appropriate numbers of damping cylinders and ramped depressions. Without departing from inventive concepts disclosed and/or claimed herein, any suitable numbers of damping cylinders and ramped depressions may be employed, equal to or differing from each other, that results in generation of suitable damping torque for a particular situation. Larger numbers of cylinders and grooves result in smoother generation of damping torque, at the expense of more extensive fabrication and more numerous parts. The damping cylinders and ramped depressions may each number between about 3 and about 50, preferably between about 6 and about 25, and most preferably between about 10 and about 12.

Each of the piston assemblies 203 should preferably be provided with a rounded groove-engaging end, to facilitate movement of the piston assembly through groove 220 while engaged therewith. In a most preferred embodiment of the present invention, each piston assembly 203 comprises a ball bearing 203*a,* an o-ring 203*b,* and a piston 203*c.* The piston 203*c* is provided with a circumferential groove for receiving the o-ring 203*b,* which in turn sealedly engages the piston chamber 201. The piston 203*c* is further provided with a concave end for receiving the ball bearing 203*a,* which serves as the rounded groove-engaging end of the piston assembly 203. As the piston assembly 203 moves through groove 220, ball bearing may slide and/or roll along groove 220. Since friction is not relied upon to produce the damping torque, piston assembly 203 (including ball bearing 203*a* and the concave end of piston 203*c*), groove 220, the corresponding damping members, and the corresponding damping surfaces of joint body 102 may all be thoroughly lubricated to reduce wear. In an alternative embodiment of the present invention, any type of rolling bearing may be employed as the rounded groove-engaging end of piston assembly 203, and the transverse (i.e., radial) cross-sectional profile of the grooves 220 of the damping members may be any shape suitable for guiding the motion of the particular type of rolling bearing in use. Various appropriately configured bushings and/or bearings may be employed for protecting piston chamber 201 and/or piston 203*c* from wear due to the motion of the rolling bearing.

A damped joint assembly according to the present invention may be further provided with a retainer for maintaining the damping members in engagement with the corresponding damping surfaces of joint body 102. For example, FIGS. 1 and 2 show shaft 107 having a retaining pin 131 inserted through a transverse bore at one end, and threads 132, spacer 133, and nut 134 at the other end. In an alternative embodiment of the present invention, any mechanical means may be employed to retain a pair of damping members in engagement with the corresponding damping surfaces of the joint body. Many examples of such mechanical means are disclosed in the patents and application cited hereinabove and incorporated herein by reference. Such mechanical means may include but are not limited to: hydraulic means, pneumatic means, levers, cams, push rods, pistons, nuts, screws, threads, clamps, functional equivalents thereof, and/or combinations thereof. The mechanical means may further include: one or more pins, one or more retaining rings, one or more snap rings, one or more radial flanges, functional equivalents thereof, and/or combinations thereof. In an alternative embodiment of the present invention, the retainer may further comprise any means for transmitting compressive forces to the damping members, including but not limited to: substantially rigid spacers, thrust bearings of any type, belleville springs, coil springs, leaf springs, elastomeric springs, hydraulic springs, pneumatic springs, functional equivalents thereof, and/or combinations thereof.

It should be appreciated that the mechanism by which damping torque is generated to oppose rotational motion about a joint rotation axis in the present invention may be adapted to generate a damping force to oppose relative linear motion of two members. A configuration for achieving this may appear similar to FIG. 4. FIG. 4 depicts a linearized circumferential section of a substantially cylindrically symmetric portion of the joint assembly. It could, however, just as well represent a simple cross-section of a linear joint assembly. As one member (represented by damping members 121/123 and 122/124) slides past a second member (represented by joint body 102), pistons 203 would undergo reciprocating motion with flow of fluid through constricted passages 202, thereby producing a force opposing relative linear motion of the two members. The opposing force would increase with increasing linear velocity of the two members, in a manner completely analogous to the foregoing description.

The present invention has been set forth in the forms of its preferred and alternative embodiments. It is nevertheless intended that modifications to the disclosed damped mechanical joint assemblies may be made without departing from inventive concepts disclosed and/or claimed herein.

What is claimed is:

1. A damped mechanical joint assembly for rotatably connecting a first joined member and a second joined member, the joint assembly comprising:

a joint body adapted to be substantially non-rotatably engaged to the first joined member and having a first damping surface substantially perpendicular to a joint rotation axis, a second damping surface opposite the first damping surface and substantially parallel thereto, a plurality of damping cylinders, each comprising a first piston chamber opening onto the first damping surface, a second piston chamber opening onto the second damping surface, and a constricted passage connecting the first piston chamber and the second piston chamber, and a piston assembly slidably positioned within each of the first and second piston chambers of each of the plurality of damping cylinders;

a first damping member adapted to be substantially non-rotatably engaged to the second joined member and having a damping surface engaging the first damping surface of the joint body, the damping surface of the first damping member being provided with a substantially circular groove substantially concentric with respect to the joint rotation axis and comprising a plurality of substantially uniformly angularly spaced ramped depressions separated by groove barriers;

a second damping member adapted to be substantially non-rotatably engaged to the second joined member and having a damping surface engaging the second damping surface of the joint body, the damping surface of the second damping member being provided with a substantially circular groove substantially concentric with respect to the joint rotation axis and comprising a plurality of substantially uniformly angularly spaced ramped depressions separated by groove barriers; and a retainer for maintaining engagement of the first damping member with the first damping surface of the joint body and maintaining engagement of the second damping member with the second damping surface of the joint body, wherein:

the plurality of damping cylinders differs in number from the plurality of ramped depressions of the groove of the first damping member;

the first piston chambers of the plurality of damping cylinders are arranged in a substantially uniformly angularly spaced circular pattern, the circular pattern being substantially concentric with respect to the joint rotation axis and having a radius substantially the same as a radius of the groove of the first damping member;

the second piston chambers of the plurality of damping cylinders are arranged in a substantially uniformly angularly spaced circular pattern, the circular pattern being substantially concentric with respect to the joint rotation axis and having a radius substantially the same as a radius of the groove of the second damping member;

each of the plurality of damping cylinders is substantially filled with fluid between the piston assembly in the first piston chamber and the piston assembly in the second piston chamber, thereby urging the first piston assembly into engagement with the groove of the first damping member and urging the second piston assembly into engagement with the groove of the second damping member;

the groove of the first damping member and the groove of the second damping member each comprise the same number of depressions, and the first damping member and the second damping member are positioned so that when the piston assembly within the first piston chamber of one of the plurality of damping cylinders is located in one of the plurality of ramped depressions of the groove of the first damping member, the piston assembly within the connected second piston chamber of the damping cylinder is located at a corresponding groove barrier of the groove of the second damping member, thereby resulting in reciprocating motion of the first and second piston assemblies and concomitant flow of the fluid though the constricted passage of each of the plurality of damping cylinders as the joint body rotates about the joint rotation axis relative to the first and second damping members; and viscous resistance to flow of the fluid through the constricted passage of each of the plurality of damping cylinders as the joint body rotates relative to the first and second damping members causes a piston assembly of at least one of the plurality of damping cylinders to be urged more strongly into engagement with one of the ramped depressions of the groove of at least one of the first and second damping members, thereby producing a damping torque opposing rotation of the joint body relative to the first and second damping members, the damping torque increasing with increasing angular velocity of the joint body relative to the first and second damping members.

2. A damped mechanical joint assembly as recited in claim 1, further comprising a shaft positioned substantially coaxially with respect to the joint rotation axis, and wherein each of the joint body, the first damping member, and the second damping member is provided with a substantially coaxial bore for receiving the shaft.

3. A damped mechanical joint assembly as recited in claim 1, wherein the plurality of damping cylinders is greater than about 3 and less than about 50 in number, and the plurality of ramped depressions of the first damping member is greater than about 3 and less than about 50 in number.

4. A damped mechanical joint assembly as recited in claim 3, wherein the plurality of damping cylinders and the plurality of ramped depressions differ in number by at least two.

5. A damped mechanical joint assembly as recited in claim 4, wherein the plurality of damping cylinders is 12 in number, and the plurality of ramped depressions of the first damping member is 10 in number.

6. A damped mechanical joint assembly as recited in claim 1, wherein each piston assembly is provided with a rounded groove-engaging end.

7. A damped mechanical joint assembly as recited in claim 6, wherein:

each piston assembly comprises an o-ring for sealedly engaging the piston chamber, a ball bearing, and a piston having a concave end for receiving the ball bearing and a circumferential groove for receiving the O-ring; and the ball bearing serves as the rounded groove-engaging end of the piston assembly.

8. A damped mechanical joint assembly as recited in claim 7, further comprising a shaft positioned substantially coaxially with respect to the joint rotation axis, and wherein: each of the joint body, the first damping member, and the second damping member is provided with a substantially coaxial bore for receiving the shaft; the plurality of damping cylinders is 12 in number; the plurality of ramped depressions of the first damping member is 10 in number; and each of the first and second damping members is provided with a radially extending slotted flange for substantially non-rotatably engaging the second joined member.

9. A damped mechanical joint assembly as recited in claim 1, wherein each of the first and second damping members is provided with a radially extending slotted flange for substantially non-rotatably engaging the second joined member.

10. A damped universal joint assembly for rotatably connecting a first joined member and a second joined member, the joint assembly comprising:

a joint body having a first damping surface substantially perpendicular to a first joint rotation axis, a second damping surface opposite the first damping surface and substantially parallel thereto, a first plurality of damping cylinders, each comprising a first piston chamber opening onto the first damping surface, a second piston chamber opening onto the second damping surface, and a constricted passage connecting the first piston chamber and the second piston chamber, a piston assembly slidably positioned within each of the first and second piston chambers of each of the first plurality of damping cylinders, a third damping surface substantially perpendicular to a second joint rotation axis, a fourth damping surface opposite the third damping surface and substantially parallel thereto, a second plurality of damping cylinders, each comprising a first piston chamber opening onto the third damping surface, a second piston chamber opening onto the fourth damping surface, and a constricted passage connecting the first piston chamber and the second piston chamber, and a piston assembly slidably positioned within each of the first and second piston chambers of each of the second plurality of damping cylinders;

a first damping member adapted to be substantially non-rotatably engaged to the first joined member and having a damping surface engaging the first damping surface of the joint body, the damping surface of the first damping member being provided with a substantially circular groove substantially concentric with respect to the first joint rotation axis and comprising a plurality of substantially uniformly angularly spaced ramped depressions separated by groove barriers;

a second damping member adapted to be substantially non-rotatably engaged to the first joined member and having a damping surface engaging the second damping surface of the joint body, the damping surface of the second damping member being provided with a substantially circular groove substantially concentric with respect to the first joint rotation axis and comprising a plurality of substantially uniformly angularly spaced ramped depressions separated by groove barriers;

a first retainer for maintaining engagement of the first damping member with the first damping surface of the joint body and maintaining engagement of the second damping member with the second damping surface of the joint body;

a third damping member adapted to be substantially non-rotatably engaged to the second joined member and having a damping surface engaging the third damping surface of the joint body, the damping surface of the third damping member being provided with a substantially circular groove substantially concentric with respect to the second joint rotation axis and comprising a plurality of substantially uniformly angularly spaced ramped depressions separated by groove barriers;

a fourth damping member adapted to be substantially non-rotatably engaged to the second joined member and having a damping surface engaging the fourth damping surface of the joint body, the damping surface of the fourth damping member being provided with a substantially circular groove substantially concentric with respect to the second joint rotation axis and comprising a plurality of substantially uniformly angularly spaced ramped depressions separated by groove barriers; and a second retainer for maintaining engagement of the third damping member with the third damping surface of the joint body and maintaining engagement of the fourth damping member with the fourth damping surface of the joint body, wherein:

the first joint rotation axis and the second joint rotation axis are substantially orthogonal;

the first plurality of damping cylinders differs in number from the plurality of ramped depressions of the groove of the first damping member;

the second plurality of damping cylinders differs in number from the plurality of ramped depressions of the groove of the third damping member;

the first piston chambers of the first plurality of damping cylinders are arranged in a substantially uniformly angularly spaced circular pattern, the circular pattern being substantially concentric with respect to the first joint rotation axis and having a radius substantially the same as a radius of the groove of the first damping member;

the second piston chambers of the first plurality of damping cylinders are arranged in a substantially uniformly angularly spaced circular pattern, the circular pattern being substantially concentric with respect to the first joint rotation axis and having a radius substantially the same as a radius of the groove of the second damping member;

the first piston chambers of the second plurality of damping cylinders are arranged in a substantially uniformly angularly spaced circular pattern, the circular pattern being substantially concentric with respect to the second joint rotation axis and having a radius substantially the same as a radius of the groove of the third damping member;

the second piston chambers of the second plurality of damping cylinders are arranged in a substantially uniformly angularly spaced circular pattern, the circular pattern being substantially concentric with respect to the second joint rotation axis and having a radius substantially the same as a radius of the groove of the fourth damping member;

each of the first plurality of damping cylinders is substantially filled with fluid between the piston assembly in the first piston chamber and the piston assembly in the second piston chamber, thereby urging the first piston assembly into engagement with the groove of the first damping member and urging the second piston assembly into engagement with the groove of the second damping member;

each of the second plurality of damping cylinders is substantially filled with fluid between the piston assembly in the first piston chamber and the piston assembly in the second piston chamber, thereby urging the first piston assembly into engagement with the groove of the third damping member and urging the second piston assembly into engagement with the groove of the fourth damping member;

the groove of the first damping member and the groove of the second damping member each comprise the same number of depressions, and the first damping member and the second damping member are positioned so that when the piston assembly within the first piston chamber of one of the first plurality of damping cylinders is located in one of the plurality of ramped depressions of the groove of the first damping member, the piston assembly within the connected second piston chamber of the damping cylinder is located at a corresponding groove barrier of the groove of the second damping member, thereby resulting in reciprocating motion of the first and second piston assemblies and concomitant flow of the fluid though the constricted passage of each of the first plurality of damping cylinders as the joint body rotates about the first joint rotation axis relative to the first and second damping members;

the groove of the third damping member and the groove of the fourth damping member each comprise the same number of depressions, and the third damping member and the fourth damping member are positioned so that when the piston assembly within the first piston chamber of one of the second plurality of damping cylinders is located in one of the plurality of ramped depressions of the groove of the third damping member, the piston assembly within the connected second piston chamber of the damping cylinder is located at a corresponding groove barrier of the groove of the fourth damping member, thereby resulting in reciprocating motion of the first and second piston assemblies and concomitant flow of the fluid though the constricted passage of each of the second plurality of damping cylinders as the joint body rotates about the second joint rotation axis relative to the third and fourth damping members;

viscous resistance to flow of the fluid through the constricted passage of each of the first plurality of damping cylinders as the joint body rotates relative to the first and second damping members causes a piston assembly of at least one of the first plurality of damping cylinders to be urged more strongly into engagement with one of the ramped depressions of the groove of at least one of the first and second damping members, thereby producing a damping torque opposing rotation of the joint body relative to the first and second damping members, the damping torque increasing with increasing angular velocity of the joint body relative to the first and second damping members; and viscous resistance to flow of the fluid through the constricted passage of each of the second plurality of damping cylinders as the joint body rotates relative to the third and fourth damping members causes a piston assembly of at least one of the second plurality of damping cylinders to be urged more strongly into engagement with one of the ramped depressions of the groove of at least one of the third and fourth damping members, thereby producing a damping torque opposing rotation of the joint body relative to the third and fourth damping members, the damping torque increasing with increasing angular velocity of the joint body relative to the third and fourth damping members.

11. A damped universal joint assembly as recited in claim 10, further comprising a first shaft positioned substantially coaxially with respect to the first joint rotation axis and a second shaft positioned substantially coaxially with respect to the second joint rotation axis, wherein: each of the joint body, the first damping member, and the second damping member is provided with a substantially coaxial bore for receiving the first shaft; and each of the joint body, the third damping member, and the fourth damping member is provided with a substantially coaxial bore for receiving the second shaft.

12. A damped universal joint assembly as recited in claim 10, wherein the first plurality of damping cylinders is greater than about 3 and less than about 50 in number, the second plurality of damping cylinders is greater than about 3 and less than about 50 in number, the plurality of ramped depressions of the first damping member is greater than about 3 and less than about 50 in number, and the plurality of ramped depressions of the third damping member is greater than about 3 and less than about 50 in number.

13. A damped universal joint assembly as recited in claim 12, wherein the first plurality of damping cylinders and the plurality of ramped depressions of the first damping member differ by at least two in number, and the second plurality of damping cylinders and the plurality of ramped depressions of the third damping member differ by at least two in number.

14. A damped universal joint assembly as recited in claim 13, wherein the first plurality of damping cylinders is 12 in number, the second plurality of damping cylinders is 12 in number, the plurality of ramped depressions of the first damping member is 10 in number, and the plurality of ramped depressions of the third damping member is 10 in number.

15. A damped universal joint assembly as recited in claim 10, wherein each piston assembly is provided with a rounded groove-engaging end.

16. A damped universal joint assembly as recited in claim 15, wherein:

each piston assembly comprises an o-ring for sealedly engaging the piston chamber, a ball bearing, and a piston having a concave end for receiving the ball bearing and a circumferential groove for receiving the O-ring; and the ball bearing serves as the rounded groove-engaging end of the piston assembly.

17. A damped universal joint assembly as recited in claim 16, further comprising a first shaft positioned substantially coaxially with respect to the first joint rotation axis and a second shaft positioned substantially coaxially with respect to the second joint rotation axis, wherein: each of the joint body, the first damping member, and the second damping member is provided with a substantially coaxial bore for receiving the first shaft; each of the joint body, the third damping member, and the fourth damping member is provided with a substantially coaxial bore for receiving the second shaft; the first plurality of damping cylinders is 12 in number; the second plurality of damping cylinders is 12 in number; the plurality of ramped depressions of the first damping member is 10 in number; the plurality of ramped depressions of the third damping member is 10 in number; each of the first and second damping members is provided with a radially extending slotted flange for substantially non-rotatably engaging the first joined member; each of the third and fourth damping members is provided with a radially extending slotted flange for substantially non-rotatably engaging the second joined member.

18. A damped universal joint assembly as recited in claim 10, wherein each of the first and second damping members is provided with a radially extending slotted flange for substantially non-rotatably engaging the first joined member, and each of the third and fourth damping members is provided with a radially extending slotted flange for substantially non-rotatably engaging the second joined member.

19. A damped swivel link assembly for rotatably suspending a grapple from a boom of a logging skidder, the assembly comprising:

a joint body having a first damping surface substantially perpendicular to a first joint rotation axis, a second damping surface opposite the first damping surface and substantially parallel thereto, a first plurality of damping cylinders, each comprising a first piston chamber opening onto the first damping surface, a second piston chamber opening onto the second damping surface, and a constricted passage connecting the first piston chamber and the second piston chamber, a piston assembly slidably positioned within each of the first and second piston chambers of each of the first plurality of damping cylinders, a third damping surface substantially perpendicular to a second joint rotation axis, a fourth damping surface opposite the third damping surface and substantially parallel thereto, a second plurality of damping cylinders, each comprising a first piston chamber opening onto the third damping surface, a second piston chamber opening onto the fourth damping surface, and a constricted passage connecting the first piston chamber and the second piston chamber, and a piston assembly slidably positioned within each of the first and second piston chambers of each of the second plurality of damping cylinders;

a first damping member adapted to be substantially non-rotatably engaged to the boom and having a damping surface engaging the first damping surface of the joint body, the damping surface of the first damping member being provided with a substantially circular groove substantially concentric with respect to the first joint rotation axis and comprising a plurality of substantially uniformly angularly spaced ramped depressions separated by groove barriers;

a second damping member adapted to be substantially non-rotatably engaged to the boom and having a damping surface engaging the second damping surface of the joint body, the damping surface of the second damping member being provided with a substantially circular groove substantially concentric with respect to the first joint rotation axis and comprising a plurality of substantially uniformly angularly spaced ramped depressions separated by groove barriers;

a first retainer for maintaining engagement of the first damping member with the first damping surface of the joint body and maintaining engagement of the second damping member with the second damping surface of the joint body;

a third damping member adapted to be substantially non-rotatably engaged to the grapple and having a damping surface engaging the third damping surface of the joint body, the damping surface of the third damping member being provided with a substantially circular groove substantially concentric with respect to the second joint rotation axis and comprising a plurality of substantially uniformly angularly spaced ramped depressions separated by groove barriers;

a fourth damping member adapted to be substantially non-rotatably engaged to the grapple and having a damping surface engaging the fourth damping surface of the joint body, the damping surface of the fourth damping member being provided with a substantially circular groove substantially concentric with respect to the second joint rotation axis and comprising a plurality of substantially uniformly angularly spaced ramped depressions separated by groove barriers; and a second retainer for maintaining engagement of the third damping member with the third damping surface of the joint body and maintaining engagement of the fourth damping member with the fourth damping surface of the joint body, wherein:

the first joint rotation axis and the second joint rotation axis are substantially orthogonal;

the first plurality of damping cylinders differs in number from the plurality of ramped depressions of the groove of the first damping member;

the second plurality of damping cylinders differs in number from the plurality of ramped depressions of the groove of the third damping member;

the first piston chambers of the first plurality of damping cylinders are arranged in a substantially uniformly angularly spaced circular pattern, the circular pattern being substantially concentric with respect to the first joint rotation axis and having a radius substantially the same as a radius of the groove of the first damping member;

the second piston chambers of the first plurality of damping cylinders are arranged in a substantially uniformly angularly spaced circular pattern, the circular pattern being substantially concentric with respect to the first joint rotation axis and having a radius substantially the same as a radius of the groove of the second damping member;

the first piston chambers of the second plurality of damping cylinders are arranged in a substantially uniformly angularly spaced circular pattern, the circular pattern being substantially concentric with respect to the second joint rotation axis and having a radius substantially the same as a radius of the groove of the third damping member;

the second piston chambers of the second plurality of damping cylinders are arranged in a substantially uniformly angularly spaced circular pattern, the circular pattern being substantially concentric with respect to the second joint rotation axis and having a radius substantially the same as a radius of the groove of the fourth damping member;

each of the first plurality of damping cylinders is substantially filled with fluid between the piston assembly in the first piston chamber and the piston assembly in the second piston chamber, thereby urging the first piston assembly into engagement with the groove of the first damping member and urging the second piston assembly into engagement with the groove of the second damping member;

each of the second plurality of damping cylinders is substantially filled with fluid between the piston assembly in the first piston chamber and the piston assembly in the second piston chamber, thereby urging the first piston assembly into engagement with the groove of the third damping member and urging the second piston assembly into engagement with the groove of the fourth damping member;

the groove of the first damping member and the groove of the second damping member each comprise the same number of depressions, and the first damping member and the second damping member are positioned so that when the piston assembly within the first piston chamber of one of the first plurality of damping cylinders is located in one of the plurality of ramped depressions of the groove of the first damping member, the piston assembly within the connected second piston chamber of the damping cylinder is located at a corresponding groove barrier of the groove of the second damping member, thereby resulting in reciprocating motion of the first and second piston assemblies and concomitant flow of the fluid though the constricted passage of each of the first plurality of damping cylinders as the joint body rotates about the first joint rotation axis relative to the first and second damping members;

the groove of the third damping member and the groove of the fourth damping member each comprise the same number of depressions, and the third damping member and the fourth damping member are positioned so that when the piston assembly within the first piston chamber of one of the second plurality of damping cylinders is located in one of the plurality of ramped depressions of the groove of the third damping member, the piston assembly within the connected second piston chamber of the damping cylinder is located at a corresponding groove barrier of the groove of the fourth damping member, thereby resulting in reciprocating motion of the first and second piston assemblies and concomitant flow of the fluid though the constricted passage of each of the second plurality of damping cylinders as the joint body rotates about the second joint rotation axis relative to the third and fourth damping members;

viscous resistance to flow of the fluid through the constricted passage of each of the first plurality of damping cylinders as the joint body rotates relative to the first and second damping members causes a piston assembly of at least one of the first plurality of damping cylinders to be urged more strongly into engagement with one of the ramped depressions of the groove of at least one of the first and second damping members, thereby producing a damping torque opposing rotation of the joint body relative to the first and second damping members, the damping torque increasing with increasing angular velocity of the joint body relative to the first and second damping members; and viscous resistance to flow of the fluid through the constricted passage of each of the second plurality of damping cylinders as the joint body rotates relative to the third and fourth damping members causes a piston assembly of at least one of the second plurality of damping cylinders to be urged more strongly into engagement with one of the ramped depressions of the groove of at least one of the third and fourth damping members, thereby producing a damping torque opposing rotation of the joint body relative to the third and fourth damping members, the damping torque increasing with increasing angular velocity of the joint body relative to the third and fourth damping members.

20. A damped swivel link assembly as recited in claim 19, further comprising a first shaft positioned substantially coaxially with respect to the first joint rotation axis and a second shaft positioned substantially coaxially with respect to the second joint rotation axis, wherein: each of the joint body, the first damping member, and the second damping member is provided with a substantially coaxial bore for receiving the first shaft; and each of the joint body, the third damping member, and the fourth damping member is provided with a substantially coaxial bore for receiving the second shaft.

21. A damped swivel link assembly as recited in claim 19, wherein the first plurality of damping cylinders is greater than about 3 and less than about 50 in number, the second plurality of damping cylinders is greater than about 3 and less than about 50 in number, the plurality of ramped depressions of the first damping member is greater than about 3 and less than about 50 in number, and the plurality of ramped depressions of the third damping member is greater than about 3 and less than about 50 in number.

22. A damped swivel link assembly as recited in claim 21, wherein the first plurality of damping cylinders and the plurality of ramped depressions of the first damping member differ by at least two in number, and the second plurality of damping cylinders and the plurality of ramped depressions of the third damping member differ by at least two in number.

23. A damped swivel link assembly as recited in claim 21, wherein the first plurality of damping cylinders is 12 in number, the second plurality of damping cylinders is 12 in number, the plurality of ramped depressions of the first damping member is 10 in number, and the plurality of ramped depressions of the third damping member is 10 in number.

24. A damped swivel link assembly as recited in claim 19, wherein each piston assembly is provided with a rounded groove-engaging end.

25. A damped swivel link assembly as recited in claim 24, wherein:

each piston assembly comprises an o-ring for sealedly engaging the piston chamber, a ball bearing, and a piston having a concave end for receiving the ball bearing and a circumferential groove for receiving the o-ring; and the ball bearing serves as the rounded groove-engaging end of the piston assembly.

26. A damped swivel link assembly as recited in claim 25, further comprising a first shaft positioned substantially coaxially with respect to the first joint rotation axis and a second shaft positioned substantially coaxially with respect to the second joint rotation axis, wherein: each of the joint body, the first damping member, and the second damping member is provided with a substantially coaxial bore for receiving the first shaft; each of the joint body, the third damping member, and the fourth damping member is provided with a substantially coaxial bore for receiving the second shaft; the first plurality of damping cylinders is 12 in number; the second plurality of damping cylinders is 12 in number; the plurality of ramped depressions of the first damping member is 10 in number; the plurality of ramped depressions of the third damping member is 10 in number; each of the first and second damping members is provided with a radially extending slotted flange for substantially non-rotatably engaging the boom; each of the third and fourth damping members is provided with a radially extending slotted flange for substantially non-rotatably engaging the grapple.

27. A damped swivel link assembly as recited in claim 19, wherein each of the first and second damping members is provided with a radially extending slotted flange for substantially non-rotatably engaging the boom, and each of the third and fourth damping members is provided with a radially extending slotted flange for substantially non-rotatably engaging the grapple.

* * * * *